US008945464B2

(12) United States Patent
Wang et al.

(10) Patent No.: US 8,945,464 B2
(45) Date of Patent: Feb. 3, 2015

(54) HEATING METHOD AND SYSTEM FOR CONTROLLING AIR INGRESS INTO ENCLOSED SPACES

(75) Inventors: Jinghong Wang, Kowloon (HK); Xiaoyi He, Orefield, PA (US); Jin Cao, Allentown, PA (US); Aleksandar Georgi Slavejkov, Allentown, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 13/112,081

(22) Filed: May 20, 2011

(65) Prior Publication Data

US 2012/0292833 A1 Nov. 22, 2012

(51) Int. Cl.

| | |
|---|---|
| ***C22B 9/00*** | (2006.01) |
| ***B22D 41/015*** | (2006.01) |
| ***F27D 99/00*** | (2010.01) |

(52) U.S. Cl.

CPC ..... *B22D 41/015* (2013.01); *F27D 99/0033* (2013.01)

USPC ..... 266/200; 266/44

(58) Field of Classification Search

USPC ..... 266/44, 144, 281, 901, 200; 432/9, 10, 432/225, 226, 227, 37, 4, 224; 431/9, 10, 8, 431/187, 181, 350, 353; 219/497, 492, 421, 219/425

See application file for complete search history.

(56) References Cited

U.S. PATENT DOCUMENTS

| | | | | |
|---|---|---|---|---|
| 1,057,905 | A | | 4/1913 | Widekind |
| 2,294,168 | A | | 8/1942 | Francis et al. |
| 3,412,986 | A | | 11/1968 | Sheperd et al. |
| 4,223,873 | A | | 9/1980 | Battles |
| 4,229,211 | A | | 10/1980 | Battles |
| 4,359,209 | A | | 11/1982 | Johns |
| 4,364,729 | A | | 12/1982 | Fresch |
| 4,386,907 | A | | 6/1983 | Smith |
| 4,432,726 | A | * | 2/1984 | Gitman ..... 432/9 |
| 4,457,706 | A | * | 7/1984 | Finke et al. ..... 432/226 |
| 4,718,643 | A | * | 1/1988 | Gitman ..... 266/44 |
| 5,540,752 | A | | 7/1996 | Spoel |
| 7,549,858 | B2 | | 6/2009 | Kobayashi et al. |
| 2007/0254251 | A1 | | 11/2007 | Cao et al. |
| 2009/0220900 | A1 | | 9/2009 | Kobayashi et al. |

FOREIGN PATENT DOCUMENTS

| | | |
|---|---|---|
| BE | 901913 A1 | 7/1985 |
| CN | 2917876 Y | 7/2007 |
| CN | 201033351 Y | 3/2008 |

(Continued)

*Primary Examiner* — Roy King

*Assistant Examiner* — Michael Aboagye

(74) *Attorney, Agent, or Firm* — Michael K. Boyer; Larry S. Zelson

(57) ABSTRACT

An apparatus for heating vessels, the vessels having enclosed spaces therein and controlling air ingress into the enclosed spaces through gaps. The method includes providing a lid structure for the vessel having the enclosed space, the lid structure having a burner assembly mounted therein. The burner is configured to provide a predetermined flame diameter. The vessel and lid structure are mated such that the gap is formed between the vessel and the lid structure. Fuel and oxidant are discharged from the burner assembly under conditions to provide the predetermined flame diameter and impart a flame velocity sufficiently large to create an outward gas flow from the enclosed space through the gap and control air ingress.

6 Claims, 8 Drawing Sheets

(56) References Cited

FOREIGN PATENT DOCUMENTS

| | | | | | |
|---|---|---|---|---|---|
| CN | 201500778 | U | | 6/2010 | |
| JP | 2008279480 | | | 11/2008 | |
| KR | 2000004271 | | | 7/2000 | |
| KR | 2004-0056882 | A | | 12/2002 | |
| KR | 20040056882 | | * | 7/2004 | ..... F23D 14/48 |
| KR | 100817111 | | | 3/2008 | |

* cited by examiner

Fig 8 Air Entrainment
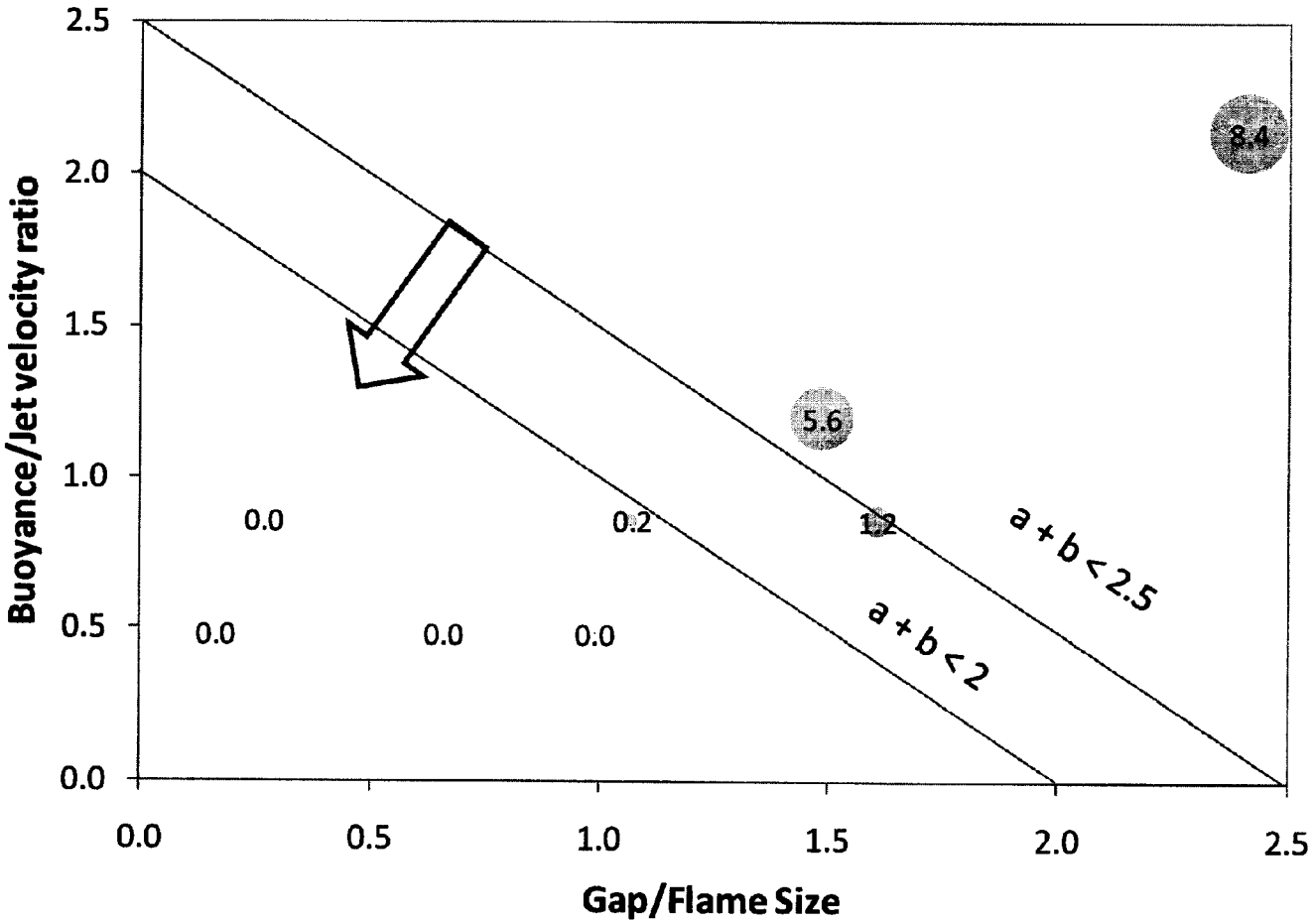

Fig 9 Heating Time
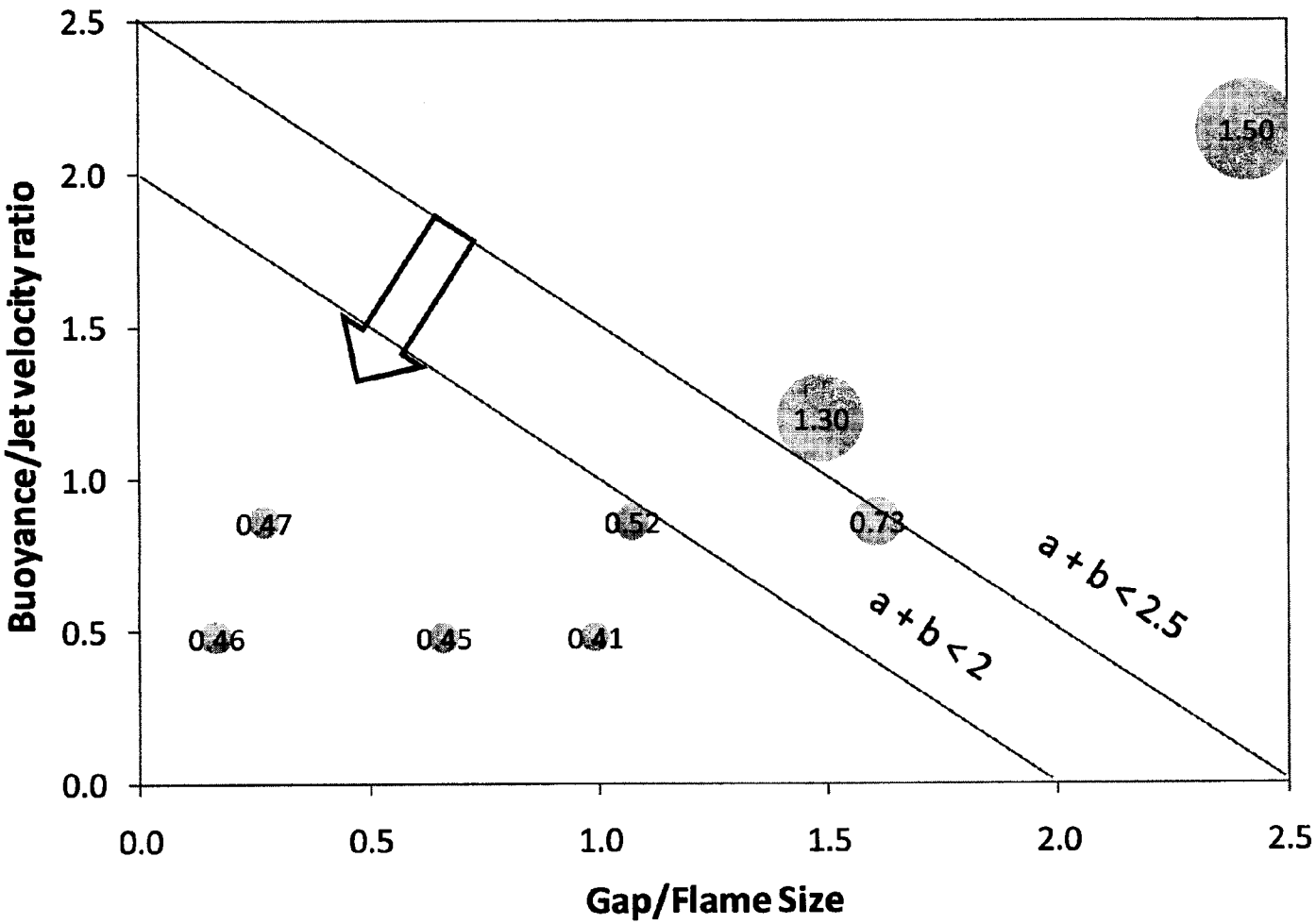

HEATING METHOD AND SYSTEM FOR CONTROLLING AIR INGRESS INTO ENCLOSED SPACES

BACKGROUND OF THE INVENTION

This disclosure is generally directed to methods and systems for heating in an enclosed space. In particular, the disclosure is directed to a method and system for preheating ladles having an enclosed space for use with molten metal.

In the metal industry, refractory lined ladles are commonly used to transport or store molten metal prior to further processing. The ladles are heated prior to use, typically referred to as ladle preheating, to minimize cooling of the molten product. Normally, the ladles are heated by combustion systems whereby fuel is fired to generate combustion heat in the cavity of the ladle. In practical operation, the lip of the ladle is normally covered with solidified chunks of metal and other types of slag from use, which forms an inevitable gap between the lid of the ladle and the ladle rim. The gap may be substantial, wherein the gap may extend up to a few inches or more at certain locations around the lip of the ladle. Though it is common practice to use this gap as an exhaust vent for the combustion products, air entrainment through the gap into the cavity of the ladle may occur when the gap becomes too large. The cooler entrained ambient air reduces the energy efficiency of the heating system. It also increases the NO production especially when an high temperature method, such as oxy-fuel combustion, is used. This entrainment of cool air becomes a greater problem due to the buoyancy effect when the gap orients vertically. Some prior art patents have attempted to overcome the energy loss and NO production by sealing the container to reduce the air infiltration through the gap. However, in practice, these methods of sealing are difficult to achieve and maintain because the solidified chunks of metal and other types of slag covering the lip of the ladle disrupt the seal and/or cause damage to the sealing surface on the ladle heating apparatus.

Various methods of sealing of the ladle rim or the ladle heating furnace are claimed in U.S. patent application Ser. Nos. 1,057,905; 4,223,873; 4,229,211 (which is a continuation-in-part of U.S. Pat. No. 4,223,873); U.S. Pat. Nos. 4,386,907; 4,364,729; and 5,540,752, each of which are incorporated by reference in their entirety. In practice, these methods of sealing suffer from the drawback that they are difficult to achieve because the lip of the ladle is normally covered with solidified chunks of metal and other types of slag which disrupt the seal and/or cause damage to the sealing surface on the ladle heating apparatus.

Historically, the air-fuel combustion has been the conventional technology used in nearly all industrial heating processes. In general, it is easier to maintain positive pressure and minimize air leakage in air-fuel combustion due to the much larger volume of flue gases, as compared to oxy-fuel combustion, However, air-fuel combustion is generally inefficient without heat recovery methods. To improve the energy efficiency, recuperative or regenerative air-fuel combustion has been widely adapted in various melting furnaces. U.S. Pat. Nos. 1,057,905; 4,223,873; 4,229,211; 4,386,907; 4,364,729; 4,359,209; 4,718,643, Korean Patent KR2000004271A, and Belgium Patent BE901913A, each of which is hereby incorporated by reference in their entirety, disclose using recuperative or regenerative air-fuel combustion system for the ladle preheating. However, these recuperative or regenerative air-fuel combustion systems are complicated, expensive, and commonly require frequent maintenance.

U.S. Pat. No. 1,057,905 introduces an apparatus for drying and heating the ladle by using the air fuel combustion. To seal the ladle rim and preheat the combustion air, the method disclosed in U.S. Pat. No. 1,057,905 inverts the ladle and places the ladle over the furnace. By doing so, flue gas is prevented from escaping and no ambient air is entrained from the rim of the ladle. Drawbacks of the U.S. Pat. No. 1,057,905 include the following: (1) The ladle must be inverted which is an unacceptable posture for large steel mill ladles; (2) In actual operation, it is difficult to keep the rim of the ladle clean or make solidified metal and slag evenly distributed along the rim. These limitations make it difficult to ensure the seal connection when docking the rough rim of the ladle with the furnace.

U.S. Pat. No. 4,223,873 discloses a recuperative air-fuel flame ladle heating method and apparatus. To prevent excessive leakage between the interior of the ladle and the outside atmosphere, a circular seal comprising a ceramic fiber compaction material is added between the rim of the ladle and the opening of the casing of the heat exchanger system and the burner system. This method utilizes additional material and does not prevent buildup of material along the lip of the ladle thereby having limited use in sealing the ladle.

U.S. Pat. No. 4,229,211 discloses a ladle heated by a direct air-fuel flame. A seal is applied to the rim of the ladle and directing air through a heat exchanger and to the ladle, mixing fuel with the air and igniting the mixture and directing the flame in to the ladle chamber, and exhausting the gases of combustion from the ladle chamber back through the heat exchanger. The seal applied to the rim of the ladle comprises a network of refractory fiber modules mounted in a common plane. Each module comprises a rectangular block formed of a web of refractory fibers in an accordion folded arrangement, and the modules are mounted with their folded edges exposed, and with the folds of each module extending at right angles with respect to the folds of the adjacent modules. The method of U.S. Pat. No. 4,229,211 suffers from the drawback that it cannot be properly utilized in many cases without clearing the rim of the ladle to remove solidified metal and slag, and the heat wall must be relined frequently due to damage to the compressible lining of the seal assembly of the heater by docking with the rough rim of the ladle.

U.S. Pat. No. 4,386,907 discloses a sealing means for preheating the ladle with the stopper rod opening. The method of the U.S. Pat. No. 4,386,907 suffers from the drawback that it requires additional materials and structures for sealing and does not prevent buildup material along the lip of the ladle, thereby having limited use in sealing the ladle.

U.S. Pat. No. 4,364,729 discloses a ladle heating system with air seal and heat shield. The ladle is heated by a direct flame, by applying a lid to the rim of the ladle and directing an air stream through a heat exchanger and through the lid to the ladle, mixing fuel with the air and igniting the mixture and directing the flame into the ladle chamber, and exhausting the gases of combustion from the ladle chamber through the lid and heat exchanger. A heat shield is mounted adjacent the lid and is sized and shaped to telescopically receive the rim of the ladle, and a ring of air is moved between the heat shield and the rim of the ladle to an air pickup ring. The ring of air blocks the gases escaping from inside the ladle through any openings between the ladle rim and the lid, the heat shield blocks heat radiation from any such openings. The U.S. Pat. No. 4,364,729 suffers from the drawback that the process requires an air shield to prevent gases from escaping, but does not prevent ingress of air into the ladle.

U.S. Pat. No. 5,540,752 discloses a process and apparatus for recovering a non-ferrous metal in molten coherent form from the scrap and dross. The scrap and dross are introduced through a sealable rotary furnace. A seal means of the furnace is described to exclude the leakage of ambient air to the rotary furnace. The U.S. Pat. No. 5,540,752 discloses a seal structure that does not prevent the buildup of material on the lip of the ladle, thereby limiting to use in sealing the ladle.

U.S. Pat. No. 2,294,168, which is hereby incorporated by reference in its entirety, discloses a special type of gas burner, designed for the heating of the interior surfaces of vessels of circular cross section, particularly, of such vessels as hot metal ladles. The said gas burner comprises an air conduit extending into the vessel and a gas feeding pipe within the conduit. The tip of the said burner includes a Venturi opening to direct hot combustion products upwardly around the air conduit to preheat air provided through the air conduit. The Venturi opening form of the burner tip creates pressure differentials in the vessel for swirling the hot products of combustion uniformly against the walls of the vessel being heated. The U.S. Pat. No. 2,294,168 suffers from the drawback that burner structures extend into the vessel creating greater exposure for the components, and thereby increasing the maintenance costs and/or material costs for the burner.

U.S. Pat. No. 4,359,209 discloses a ladle preheat apparatus and method which utilizes recuperation but which totally eliminates the need to create any seal between the rim of the ladle and the ladle lid. The said ladle preheat method comprises an outer casing defining an opening for receiving the combustion products from the ladle. The opening is dimensioned so as to form a dilution air space about the ladle which permits ambient air to be drawn in therearound and to mix with the combustion products. The U.S. Pat. No. 4,359,209 suffers from the drawbacks that ambient air is drawn in to the area of combustion completely surrounding or partially surrounding the ladle. The seal means by the air space is to prevent the combustion products from exhausting to the ambient; however, the ambient air may be drawn into the ladle and reduce the flame temperature and potentially increase $NO_x$ production.

U.S. Pat. No. 3,412,986, which is hereby incorporated by reference in its entirety, discloses a double-ended oxy-fuel burner which is intended especially for heating ladles (torpedo ladles) that are used in iron and steel works for transporting molten metal from a blast furnace to another location. The said burner is used to preheat the ladle or keep the ladle from cooling between successive loads of metal. The burner is proportioned to the ladle and has oppositely directed orifices for producing long flames and for projecting them in opposite directions. The burner is constructed with water cooling jackets extending all the way to the ends of the tips so that the burner can withstand the high temperature within the ladle. The said burner includes two concentric tubes. The inner tube is for fuel and the outer is for oxygen. At the tips of the burner, the fuel is introduced to the ladle through one tube. The oxygen stream is introduced to the ladle through multiple orifices which are distributed annularly along the central fuel tube. The U.S. Pat. No. 3,412,986 suffers from the drawback that the burner includes significant structures that extend into the vessel, thereby increasing maintenance costs and/or material costs for the burner.

U.S. Pat. No. 4,718,643, which is hereby incorporated by reference in its entirety, discloses a method and apparatus for rapid high temperature ladle preheating utilizing an optimized heating cycle by involving oxygen and combustion air preheated by recuperation in the fuel burning process. Controlled oxygen flow directed into the process is used to increase the heat input during the initial preheating phase and to insure efficiency of the system during the soaking phase of ladle preheating. The disclosed ladle lid comprises a partially open refractory ring for docking a portion of a ladle rim having a significant protrusion caused by a local accumulation of solidified metal or slag. The flame from the burner located in the ladle lid transfers heat to the interior of the ladle and the flue gases are discharged from the ladle into the exhaust port. As the ladle is partially sealed, some ambient air is drawn into the exhaust port around the lip of the ladle. The drawing in of ambient air creates an effective seal of the ladle, which prevents a chimney effect which would draw hot gases out of the ladle if the ladle is not positioned very closely to the lid of the ladle. Therefore, the U.S. Pat. No. 4,718,643 permits the handling of rough-edged ladles without destroying the seal. U.S. Pat. No. 4,718,643 suffers from the drawback that, as the ladle is partially sealed, exterior ambient air is drawn through the opening toward the interior of the ladle, reducing the flame temperature and potentially increasing $NO_x$ production.

Korean Patent No. KR20040056882, which is hereby incorporated by reference in its entirety, discloses a multi-hole nozzle burner for heating a ladle is provided to reduce $NO_x$ emissions and save fuel by reducing heating time. The multi-hole nozzle burner is installed at the center of an upper ladle cover, and has a triple ring-shaped structure, which includes an ignition air nozzle having a single jet, fuel nozzles surrounding the ignition air nozzle and having multiple jets, and combustion air nozzles enclosing the fuel nozzles and having multiple jets. The KR20040056882 system suffers from the drawback that the combustion utilizes only air-fuel combustion, which has reduced flame temperature and increased $NO_x$ production.

Korean Patent No. KR20000042710A discloses a regenerative burner is provided to save the energy. Combustion gas is sufficiently circulated inside the ladle by using a high velocity nozzle-mixing type burner. The K20000042710A system suffers from the drawback that the combustion only utilizes air-fuel combustion, which has reduced flame temperature and increased $NO_x$ production.

U.S. Patent Application Publication US20090220900, which is a divisional application of U.S. Pat. No. 7,549,858, both of which are hereby incorporated by reference in their entirety, discloses heating provided by a burner that combusts a hydrocarbon fuel which can be provided at a sequence of different heat transfer rates by adjusting the total oxygen concentration of oxidant streams fed to the burner. However, the impact of the burner on the air ingress into the heating vessel is not considered by the US20090220900.

Belgium Patent Publication No. BE901913A, which is hereby incorporated by reference in its entirety, discloses a ladle heating system that involves the use of a fixed hood to which the ladles are moved into position. The fixed hood is provided with a burner in its upper section and a waste gas outlet in its lower section. Burnt gases are circulated in the ladle at relatively high speed to ensure uniform heating. Heat in the waste gases is recovered by means of either a recuperative or a regenerative system enabling combustion air and possibly combustion gas to be preheated. The BE901913A Publication suffers from the drawback that air ingress is not prevented, which reduces flame temperature and increases $NO_x$ production.

Flameless combustion is a combustion technology wherein the reactants for combustion are highly diluted before they mix and react. Flameless combustion is typically utilized when $NO_x$ control is desired. The reactants usually are diluted by entraining combustion products before the combustion reactions occur. This mode of combustion typically occurs when the oxidizing gas is diluted to a level below 17% oxygen, wherein the flame front disappears and the fuel oxidizes in a flameless fashion. The key to this technology is the maintenance of the furnace temperature above the auto-ignition temperature of the fuel or the use of a highly-robust flame stabilizer. This type of combustion is usually characterized by high jet momentum and a large combustion volume. Flameless combustion can alternatively be referred to as spacious or distributed combustion.

There is a need in the metals industries for heating methods and systems for enclosed spaces, such as ladle and furnace heating that reduce or eliminate air ingress. These needs are addressed by the embodiments of the present invention as described below and defined by the claims that follow.

BRIEF SUMMARY OF THE INVENTION

One aspect of the present disclosure includes a method for heating vessels, the vessels having enclosed spaces therein and controlling air ingress into the enclosed spaces through a gap. The method includes providing a lid structure for the vessel having the enclosed space, the lid structure having a burner assembly mounted therein. The burner assembly is configured to provide a predetermined flame diameter. While any suitable flame diameter can be employed and will vary dependent upon the size of the heating vessels, examples of suitable flame diameters is less than or equal to 20 inches, preferably between 8 and 10 inches.

The vessel and lid structure are mated such that the gap is formed between the vessel and the lid structure. Fuel and oxidant are discharged from the burner assembly under conditions to provide the predetermined flame diameter and impart a flame velocity sufficiently large to create an outward gas flow from the enclosed space through the gap and control air ingress.

Another aspect of the present disclosure includes a method for heating vessels, the vessels having enclosed spaces therein and controlling air ingress into the enclosed spaces through the gap. The method includes providing a lid structure for the vessel having an enclosed space. The lid structure has a burner assembly mounted therein. The burner assembly includes (a) an elongated body having a periphery, a discharge end adjacent a combustion zone, and an axis, wherein the axis extends into the combustion zone; (b) one or more oxidant nozzles disposed at the discharge end of the elongated body and adapted to discharge the oxidant into the combustion zone; and (c) one or more fuel nozzles disposed at the discharge end of the elongated body and adapted to discharge the fuel into the combustion zone. The one or more oxidant nozzles and one or more fuel nozzles are configured to provide a burner configuration ratio and a burner velocity ratio to create the outward gas flow from the enclosed space through the gap and control air ingress.

In another embodiment, the method includes configuring the burner assembly to provide a burner configuration ratio determined according to the following equation:

$$a=A_{gap}/(200A_{bf});$$

where $A_{gap}$ is the area of the gap and $A_{bf}$ is the area of the burner face, and the burner velocity ratio is determined according the following equation:

$$b=3V_{buoy}/V_{jet};$$

where $V_{buoy}$ is determined by the following equation:

$$V_{buoy}=(2gD_{ladle}\Delta T/T_{flame})^{1/2}$$

g being the gravity constant, $D_{ladle}$ is the diameter of a ladle, $\Delta T$ is the temperature difference between the flame and ladle wall, and $T_{flame}$ is the flame temperature. The sum of the burner configuration ratio, a, and the burner velocity ratio, b, is less than 2.5.

Another aspect of the present disclosure includes an apparatus for heating vessels having an enclosed space and controlling air ingress into the enclosed space and a lid structure having a burner assembly mounted therein, the vessel and lid structure mating such that a gap is formed between the vessel and the lid structure, the burner assembly including (a) an elongated body having a periphery, a discharge end adjacent a combustion zone, and an axis, wherein the axis extends into the combustion zone; (b) one or more oxidant nozzles disposed at the discharge end of the elongated body and adapted to discharge the oxidant into the combustion zone; and (c) one or more fuel nozzles disposed at the discharge end of the elongated body and adapted to discharge the fuel into the combustion zone. The burner assembly is configured to combust fuel and oxidant from the burner assembly under conditions to provide a predetermined flame diameter and impart a flame velocity sufficiently large to create an outward gas flow from the enclosed space through the gap and control air ingress.

Another aspect of the present disclosure includes an apparatus for heating vessels having an enclosed space and controlling air ingress into the enclosed space and a lid structure having a burner assembly mounted therein, the vessel and lid structure mating such that a gap is formed between the vessel and the lid structure, the burner assembly including (a) an elongated body having a periphery, a discharge end adjacent a combustion zone, and an axis, wherein the axis extends into the combustion zone; (b) one or more oxidant nozzles disposed at the discharge end of the elongated body and adapted to discharge the oxidant into the combustion zone; and (c) one or more fuel nozzles disposed at the discharge end of the elongated body and adapted to discharge the fuel into the combustion zone. The one or more oxidant nozzles and one or more fuel nozzles are configured to provide a burner configuration ratio and a burner velocity ratio to create the outward gas flow from the enclosed space through the gap and control air ingress.

In one aspect of the invention, the air ingress is substantially prevented. By substantially prevented, it is meant that the amount or volume of air ingress is less than about 5 percentage of the total amount or volume of flue gas exhausted and, in most cases, less than about 2 percentage of the total amount or volume of flue gas exhausted.

In another embodiment, the apparatus includes a burner configuration ratio that is determined according to the following equation:

$$a=A_{gap}/(200A_{bf});$$

and the burner velocity ratio is determined according the following equation:

$$b=3V_{buoy}/V_{jet};$$

wherein the sum of the burner configuration ratio, a, and the burner velocity ratio, b, is less than 2.5.

Other features and advantages of the present invention will be apparent from the following more detailed description of the preferred embodiment, taken in conjunction with the accompanying drawings which illustrate, by way of example, the principles of the invention.

BRIEF DESCRIPTION OF SEVERAL VIEWS OF THE DRAWINGS

FIG. 8 is a bubble plot showing the dependence of the air entrainment on the burner configuration ratio "a" and the burner velocity ratio "b".

FIG. 9 is a bubble plot showing the dependence of the heating time on the burner configuration ratio "a" and the burner velocity ratio "b".

DETAILED DESCRIPTION OF THE INVENTION

Figure 1:
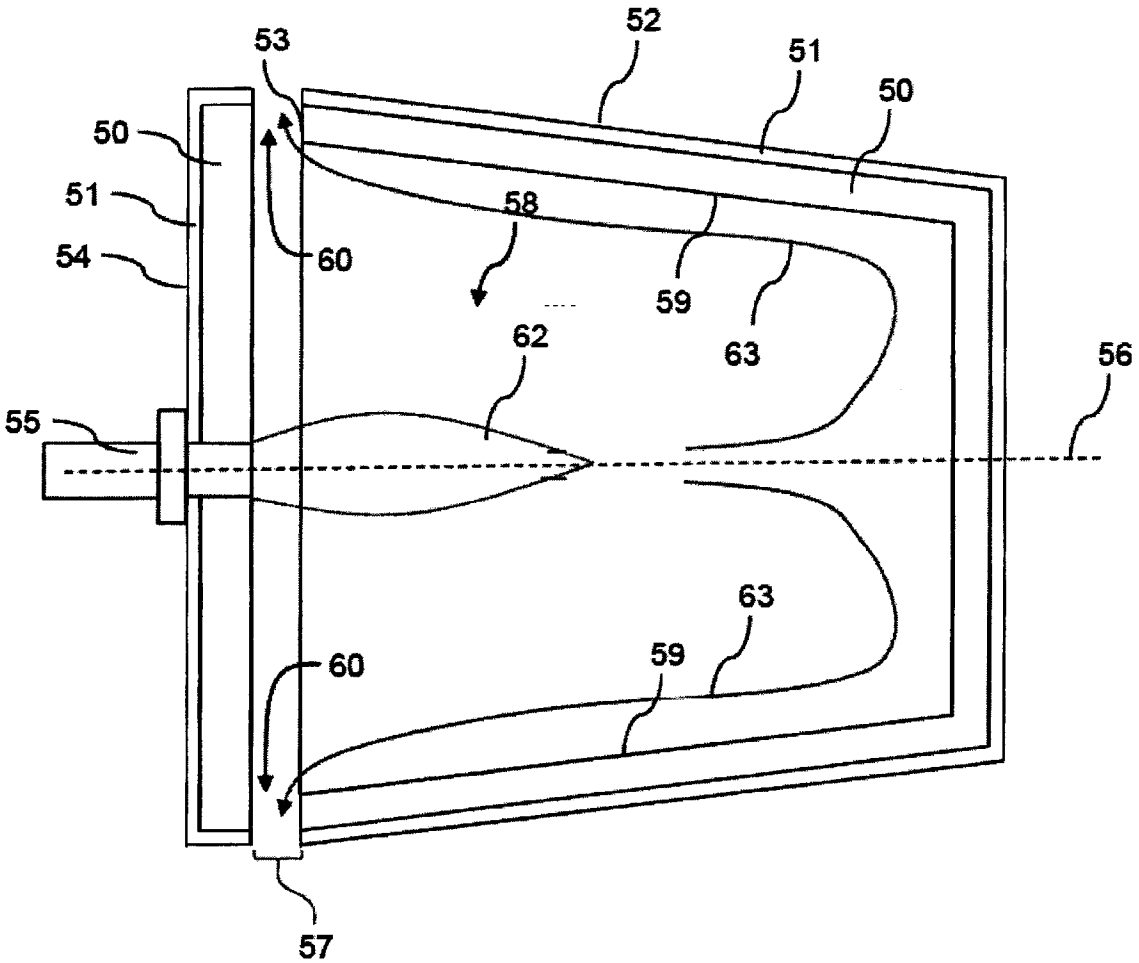
FIG. 1 is a sectional view of a ladle heating system according to an embodiment of the disclosure.

Provided is a method and system for heating in enclosed spaces, such as ladle and furnace heating, that reduces or eliminates air ingress. Advantages of embodiments of the present disclosure include substantially uniform heating and extended refractory lifetime, a reduced heating time and reduced ambient air infiltration into the interior of the ladle or the furnace, and reduction of $NO_x$ emission. In addition, in heating methods in enclosed spaces, extended operational conditions, including heating operations with larger gaps may be utilized.

Embodiments include a heating apparatus and method for the ladle preheating or melting furnaces with an air leakage problem. In one embodiment, a high-momentum spacious oxy-fuel burner is installed in the ladle lid or the furnace wall to minimize the air ingress through the ladle gap or the leakage in the furnace. The uniform heating formed by the said high-momentum spacious oxy-fuel burner inside the ladle or the furnace can help reduce the time for the completion of the ladle heating cycle, save the fuel consumption, prolong the refractory life time of the ladle or the furnace, and reduce $NO_x$.

The indefinite articles "a" and "an" as used herein mean one or more when applied to any feature in embodiments of the present invention described in the specification and claims. The use of "a" and "an" does not limit the meaning to a single feature unless such a limit is specifically stated. The definite article "the" preceding singular or plural nouns or noun phrases denotes a particular specified feature or particular specified features and may have a singular or plural connotation depending upon the context in which it is used. The adjective "any" means one, some, or all indiscriminately of whatever quantity. The term "and/or" placed between a first entity and a second entity means one of (1) the first entity, (2) the second entity, and (3) the first entity and the second entity.

In the present specification, the term "enclosed space" refers to a space or area at least partially surrounded by a wall or enclosure and is capable of having gases or combustion products introduced therein. Enclosed spaces as utilized herein are not limited to sealed containers and may include spaces, gaps or openings through which gases may enter or exit. The terms "burner assembly" and "burner" are equivalent and define an apparatus of assembled parts for the combustion of a fuel with oxygen provided in an oxygen-containing gas. The term "combustion zone" is defined as an enclosed space such as a furnace in which combustion reactions occur, at least one of which may be the reaction of a carbon and/or hydrogen-containing fuel with oxygen to form carbon oxides and/or water and heat. The term "axial body" refers to an elongated structure geometrically defined by an axis and having one dimension defined in the axial direction and another dimension defined in a radial direction orthogonal to the axis. The dimension in the radial direction may be constant at any axial location (e.g., forming a cylinder) or may vary with axial location and/or angular location around the axis. The axial body is characterized by at least one end adjacent a combustion zone.

A nozzle is a fluid injection device for the introduction of a primary fluid into a secondary fluid to promote the efficient mixing of the two fluids. The nozzle is defined by an opening through which the primary fluid is discharged into the secondary fluid. The nozzle may be attached to a hollow, typically cylindrical body that is connected to a pipe, manifold, or other type of passage for delivering the primary fluid to the nozzle. Alternatively, the nozzle may be an integral part of a manifold wherein the opening that forms the nozzle is located directly in an outer wall of the manifold. Typically, the primary fluid undergoes a drop in pressure upon passing through the nozzle.

An oxidant, or an oxidizing gas, is defined herein as an oxygen-containing gas discharged through a nozzle. The term "oxygen-enriched" describes an oxygen-containing gas having an oxygen concentration greater than that of air. The term "oxy-fuel" refers to the combustion of a fuel with an oxygen-enriched gas.

A fuel comprises an element or compound which can be combusted with oxygen to form combustion products. The term "combustion products" means a gas mixture comprising any of the following: carbon oxides, water, unreacted fuel, unreacted oxygen, oxides of nitrogen, oxides of sulfur, and inert components from air including nitrogen and argon. Typically the fuel is a single-phase gas or liquid, but alternatively may be a flowable multi-phase fluid such as a two-phase mixture of a hydrocarbon liquid and a combustible gas, a suspension of water and a liquid hydrocarbon, a suspension of a solid carbonaceous fuel in air or water, or a suspension of a solid carbonaceous fuel in a liquid hydrocarbon.

The term "air ingress", as utilized herein, is the infiltration of cooler, ambient air into an enclosed space. For example, air ingress includes infiltration of air into the enclosed space of a molten metal ladle during preheating through a gap or other opening.

Referring to FIG. 1, a burner assembly 55, such as a high-momentum oxy-fuel burner is arranged and disposed proximate to the center of the lid structure 54 of the vessel 52. Vessel 52 is preferably a ladle or similar vessel that is subjected to heating processes, where the vessel includes an enclosed space 58. Vessel 52 includes an inner refractory lining 50 and a steel outer wall 51. The flame 62 from the burner assembly 55 is directed into the enclosed space transfers heat to the inner refractory liner 50 at the interior of the vessel 52. Although flame 62 is shown as having a geometry, the geometry shown is merely exemplary and is not limited to the size or geometry shown. Flue gases 63 are permitted to discharge from the ladle gap 57 between the lid 54 of the vessel 52 and the lip 53 of the vessel 52.

Although lid structure 54 is configured to mate lip 53 of vessel 52, the contact therebetween in typical operation is not consistent and gap 57 forms therebetween. Gap 57 is a space or opening capable of permitting passage of fluid or air ingress. Gap 57 may form and may change in geometry and dimensions during use. Gap 57 generally varies circumferentially along lip 53 and is primarily due to buildup of solidified metal and/or slag. The gap 57 is measured as having an average gap size, which is a measure of the size through which air ingress and/or flue gas 63 escape may occur. The average gap size ($A_{gap}$) can be measured by the total opening area between the enclosure and ambient air. The average width of the opening can be calculated by dividing the opening area with the periphery of the vessel lip 53.

The gap 57 varies in size between a small dimension gap, generally indicating a new or newly serviced lid structure 54 and/or vessel 52, an operational gap of medium size, and a large gap where servicing may be required. When a new or newly reconditioned vessel 52 is put into service, the gap 57 between lid structure 54 and lip 53 is typically small, wherein the average gap dimension is less than about 1 inch (less than about 2.54 cm). During vessel operation, the gap 57 is extended to an operational gap, typically an average gap size of about 2 to 9 inches (5.08 to 22.86 cm) or 4 to 7 inches (10.16 to 17.78 cm) or 5 to 6 inches (12.7 to 15.24 cm). The operational gap results, for example, from solidified metal and/or slag that form from the ladle pouring cycles. The operational gap 57 may be sufficiently large to provide an opening through which, in the absence of operation of the burner assembly 55, air ingress may occur. Gaps 57 having an average gap size of larger than about 9 inches (22.86 cm) are large gaps and generally indicate a need to service the vessel 52. Generally, the larger the size of gap 57, the greater the air ingress and the longer the heating time.

Although not so limited, the gap 57 may be aligned horizontally, as shown in FIG. 1, during operation of the burner assembly 55 to provide heating in the enclosed space. Alignment of the gap, as used herein, is defined as an orientation parallel or substantially parallel to the axis 56 of vessel 52. Gap 57 may be also aligned vertically or at any other angle. The burner assembly 55 is operated to provide fuel and oxidant at a velocity and flame diameter to provide sufficiently large momentum to create an outward gas flow from the enclosed space 58 through the gap 57 and control air ingress. When gap 57 is aligned horizontally, this momentum is capable of overcoming buoyancy forces that occur in the vertical orientation. The controlling of the air ingress is such that the amount of air ingress is reduced or eliminated as compared to air ingress with a conventional oxy-fuel burner.

In one embodiment of the present disclosure, the burner assembly 55 is a burner mounted in the lid structure 54. Embodiments of the disclosure relate to high-momentum pacious oxy-fuel burner assemblies 55 capable of operating with various oxygen-containing gases having oxygen concentrations ranging from 20.9 vol % (air) to greater than 99.5 vol % (high purity oxygen).

When operating, the burner assemblies 55 described herein produce high momentum combustion by using a spacious or distributed combustion process to deliver uniform heating to the load in the furnace or combustion zone. Spacious or distributed combustion, also described in the art as flameless combustion, occurs when the fuel and oxidizer are rapidly diluted prior to reacting in the furnace. The burner assemblies 55 may be operated in various heating modes to satisfy various process requirements in the furnace.

In one mode, the highest radiative heat transfer and largest amount of available heat are provided by using oxygen concentrations up to values greater than 99.5 vol % in the gaseous oxidant injected by the oxidant nozzles. In another mode, an optimum combination of convective and radiative heat transfer is provided by operating the burners in an enriched air/fuel mode wherein the injected gaseous oxidant contains up to 65 vol % oxygen. In a third mode, cost-effective operation is provided when the process heat demand is low by using air/fuel combustion in which all gaseous oxidants and oxidizing gases are air. Operation may be switched among these three modes as needed to provide different heat transfer mechanisms and process heat requirements.

The oxy-fuel burner assembly 55 operates such that the reactants are diluted by entraining combustion products before the combustion reactions occur and provides high flame momentum compared to that of a conventional oxy-fuel flame. Burner assemblies 55, according to certain embodiments, operate with multiple fuel/oxygen injection nozzles at high flow exit velocities to generate the spacious combustion mode. The burner assembly 55 is positioned such that the flame is directed into the enclosed space 58 at a location that directs the flame along sides 59 of refractory lining 50 (see e.g., FIG. 1). The flow circulation enhanced by the high momentum flow provides substantially uniform temperature profile inside the enclosed space 58, which is beneficial to the uniform heating of the refractory lining of the vessel 52. The high momentum flow allows circulation that conforms to the sides 59 of the ladle extending to the gap 57. The circulation provides a positive pressure in the gap area 60 and substantially prevents air ingress. By substantially prevents air ingress, it is meant that the amount or volume of air ingress is less than about 5 percentage of the total amount or volume of flue gas exhausted and typically less than about 2 percentage of the total amount or volume of flue gas exhausted. While not wishing to be bound by theory, it is believed that the burner assembly 55 according to the present disclosure reduces or eliminates air ingress by providing higher dynamic pressure eventually converting to high static pressure inside the vessel. Furthermore, the uniform radial pressure distribution formed by the said spacious burner ensures an outward gas flow around the ladle lid, allowing the reduction or elimination of air ingress even when a non-uniform gap is present.

The burner assembly results in less ambient air being entrained into the furnace. Thus, the heating time can be further reduced compared to the conventional oxy-fuel burner. The reduced heating time of a ladle to the desired temperature can help the ladle users minimize the number of ladles they have in operation and can help the users save the capital cost and operating cost. In addition, the burner arrangement may be utilized for metal melting furnaces, such as secondary aluminum melting furnaces with air leakage problems. In these embodiments, reduced melting time is achieved, which reduces or eliminates excessive oxidation of molten aluminum and improving the yield.

Uniform heating of the refractory lining also reduces thermal gradients along the refractory lining compared to the conventional flame heating process, leading to fewer thermal shocks to the refractory lining. Thus, the lifetime of the refractory can be extended.

By using burner assembly 55 configured for high-momentum spacious combustion according to embodiments of the disclosures, the fuel consumption can be further reduced compared to conventional oxy-fuel burner. The use of oxygen or oxygen-enriched gas in place of air for combustion increases the flame temperature and thus the radiative heat transfer to the load, and also greatly increases the amount of available heat from the combustion process by eliminating the waste fuel heating of the nitrogen in the air.

Figure 2:
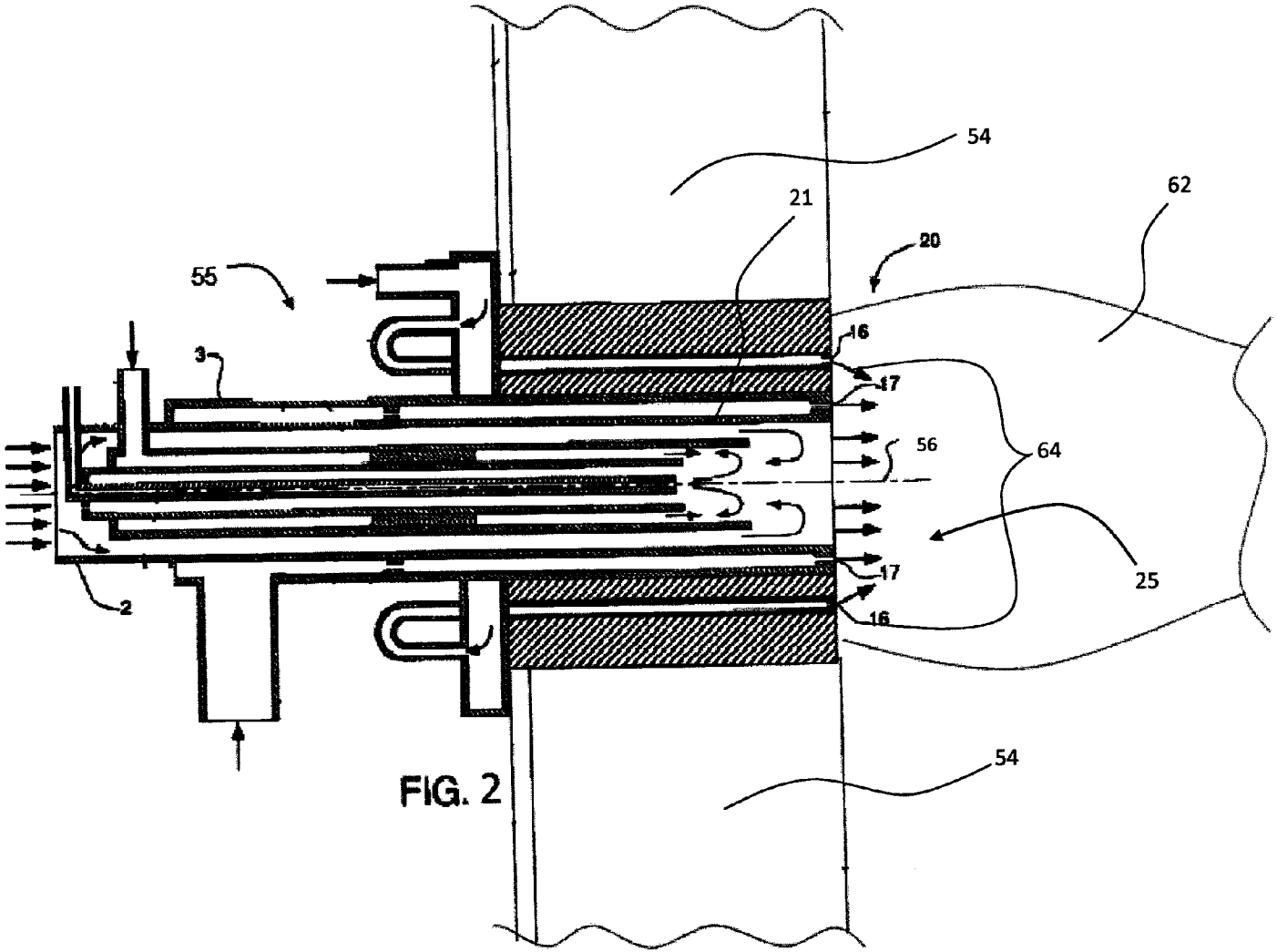
FIG. 2 is an axial section of a burner assembly according to an embodiment of the disclosure.
Figure 3:
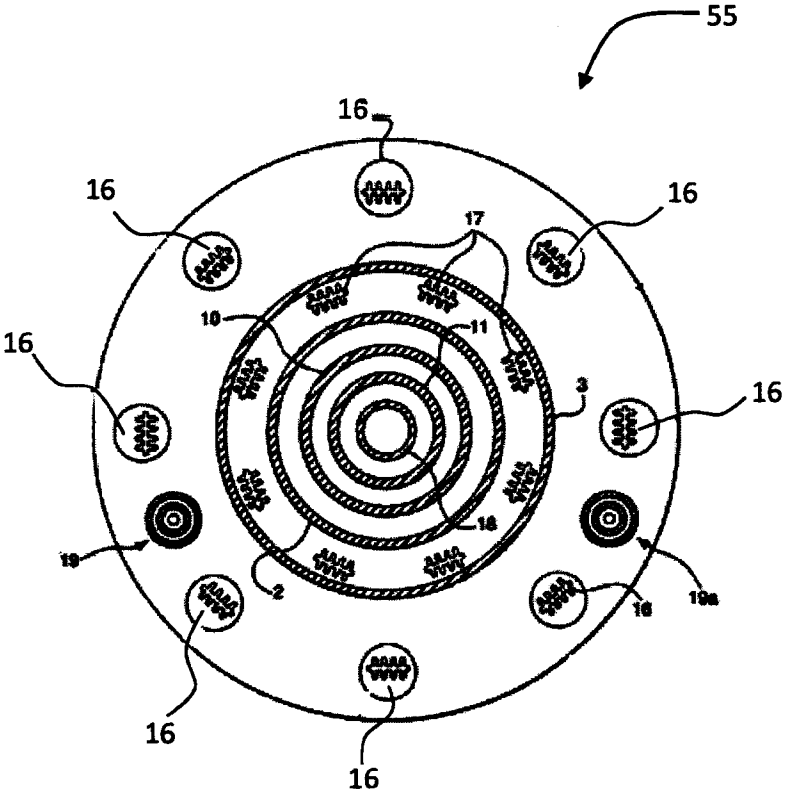
FIG. 3 is a front view of the embodiment of FIG. 2 showing the discharge end of the burner assembly.

An exemplary embodiment of a burner assembly 55 suitable for use in lid structure 54 is shown in FIG. 2 and FIG. 3. The burner assembly 55 includes an elongated body 21 having a periphery, a discharge end 25 adjacent a combustion zone 20, and an axis 56, wherein the axis 56 extends into the combustion zone 20. The burner assembly 55 comprises central oxidizing gas conduit 2 surrounded by outer gaseous oxidant pipe 3. One or more oxidant nozzles 17 are disposed at the discharge end 25 of the elongated body 21 and are adapted to discharge the oxidant into the combustion zone 20. One or more fuel nozzles 16 are disposed at the discharge end 25 of the elongated body 21 and are adapted to discharge the fuel into the combustion zone 20. The fuel and oxidant are injected in the vessel 52 at an injection velocity ($V_{jet}$). The injection velocity can be calculated by dividing the injected volume flow rate by the total area of the nozzle cross section. The high injection velocity can be achieved by adequate design of nozzles. The injection velocity, $V_{jet}$, is configured to be greater than the buoyancy velocity ($V_{buoy}$). $V_{buoy}$, can be calculated by the following equation:

$$V_{buoy}=(2gD_{ladle}\Delta T/T_{flame})^{1/2}$$

where g is the gravity constant, $D_{ladle}$ is the diameter of a ladle, ΔT is the temperature difference between the flame and ladle wall, and $T_{flame}$ is the flame temperature.

The exemplary burner assemblies 55 illustrated in FIGS. 2 and 3 utilize geometries in which the fuel nozzles 16 and oxidant nozzles 17 that are located in a circumferential arrangement around burner axis 56. In other embodiments, non-circular arrangements may be used in which the fuel nozzles 16 are located at various radial distances from the burner axis and/or in which the oxidant nozzles 17 are located at various radial distances from the burner axis 56. The outline of the fuel nozzles 16 and oxidant nozzles 17 define an area that flame 62 will anchor on and this area can be defined as the burner face 64. The burner face 64 may have a square, rectangular, or other non-circular shape in which the fuel and/or oxidant nozzles are arranged about the axis in square, rectangular, or any other non-circular orientations. According to the present disclosure, air ingress can be reduced or eliminated by using a flame 62 with large size. Specifically, one can control the air ingress by keeping a burner configuration ratio, "a", defined as the gap size and flame size, $a=A_{gap}/(200\ A_{bf})$, within a predetermined range, preferably with a less than 2.5.

Air ingress can also be reduced or eliminated by increasing the flame velocity. Specifically, one can control the air ingress by maintaining a burner operation ratio, "b", defined as the ratio of the buoyant velocity and injection velocity, $b=3V_{buoy}/V_{jet}$, within a predetermined range, preferably with b less than 2.5. $V_{buoy}$, can be calculated by the following equation:

$$V_{buoy}=(2gD_{ladle}\Delta T/T_{flame})^{1/2}$$

In one embodiment, air entrainment can be controlled at a desired level by maintaining operation of burner assembly 55 according to the following equation:

$$a+b<2.5$$

Alternatively, $$a+b<2$$

In another embodiment, the heating time can be controlled at a desired level by maintaining operation of burner assembly 55 according to the following equation:

$$a+b<2.5$$

Alternatively, $$a+b<2$$

This disclosure further teaches the air ingress can be more efficiently reduced by combining the above mentioned parameters, a and b, within an adequate range.

EXAMPLES

Figure 4:
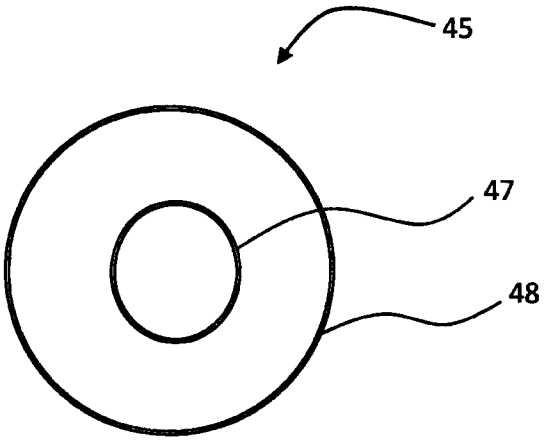
FIG. 4 is a front view of a conventional pipe-in-pipe oxygen-fuel burner.

The performance of the high-momentum spacious oxy-fuel burner (referred to as "B" burner in FIG. 5 through 7) and a traditional pipe-in-pipe oxy-fuel burner 45 as shown in FIG. 4 (referred to as "A" burner in FIG. 5 through 7) have been analyzed for the ladle preheating. The pipe-in-pipe oxy-fuel burner 45 includes a fuel outlet 47 and an oxidant outlet 48. The analysis includes three different sizes of ladles. The gap between the lid of the ladle and the rim of the ladle varies in the range of 1 inch to 10 inches. The analysis was accomplished using computational fluid dynamics (CFD) software Fluent (ANSYS/Fluent, 2008) utilizing assumption commonly used in the art.

Figure 5:
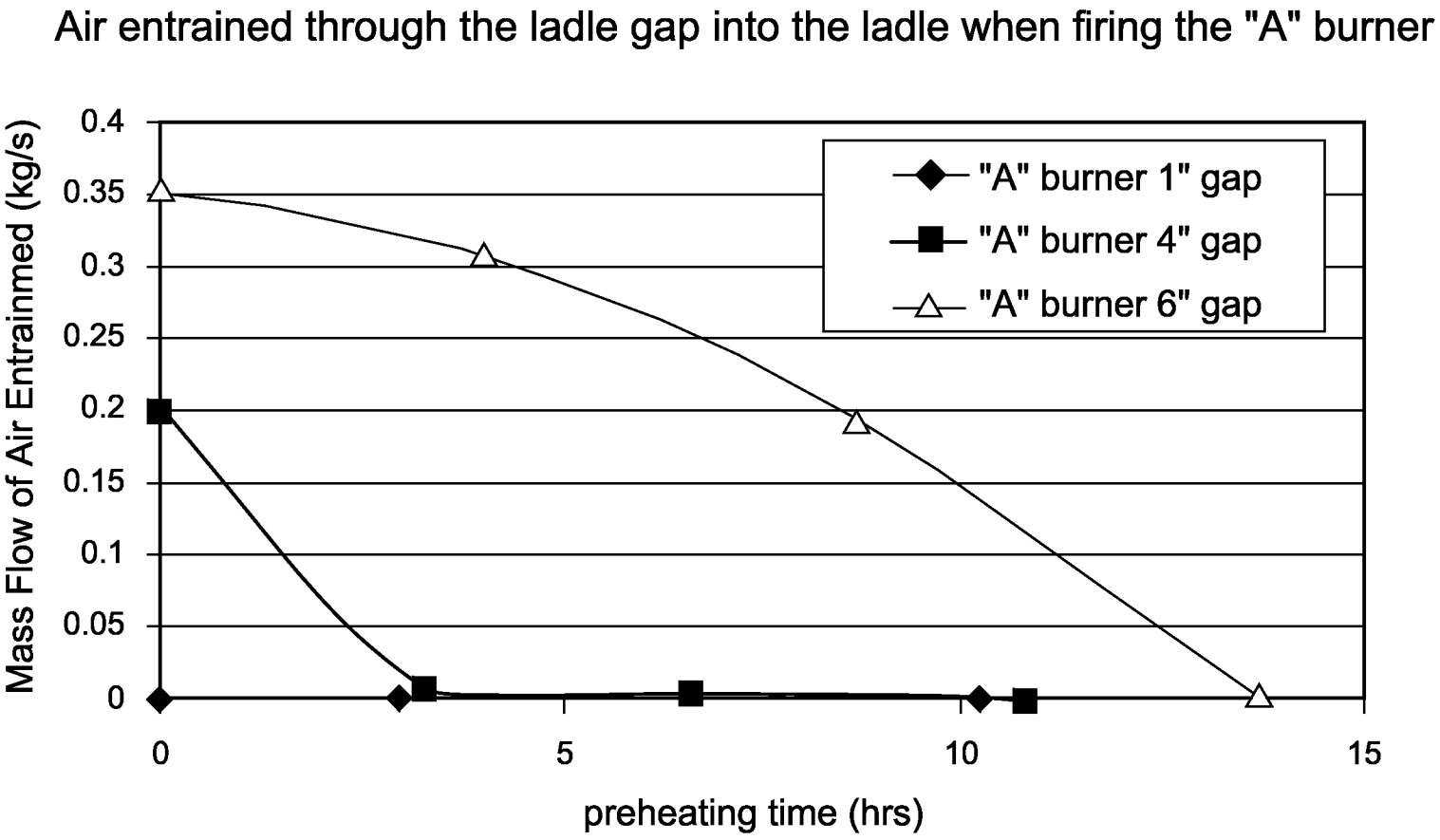
FIG. 5 is a plot of mass of air entrained vs. preheating time for high-momentum burner according to an embodiment of the disclosure.
Figure 6:
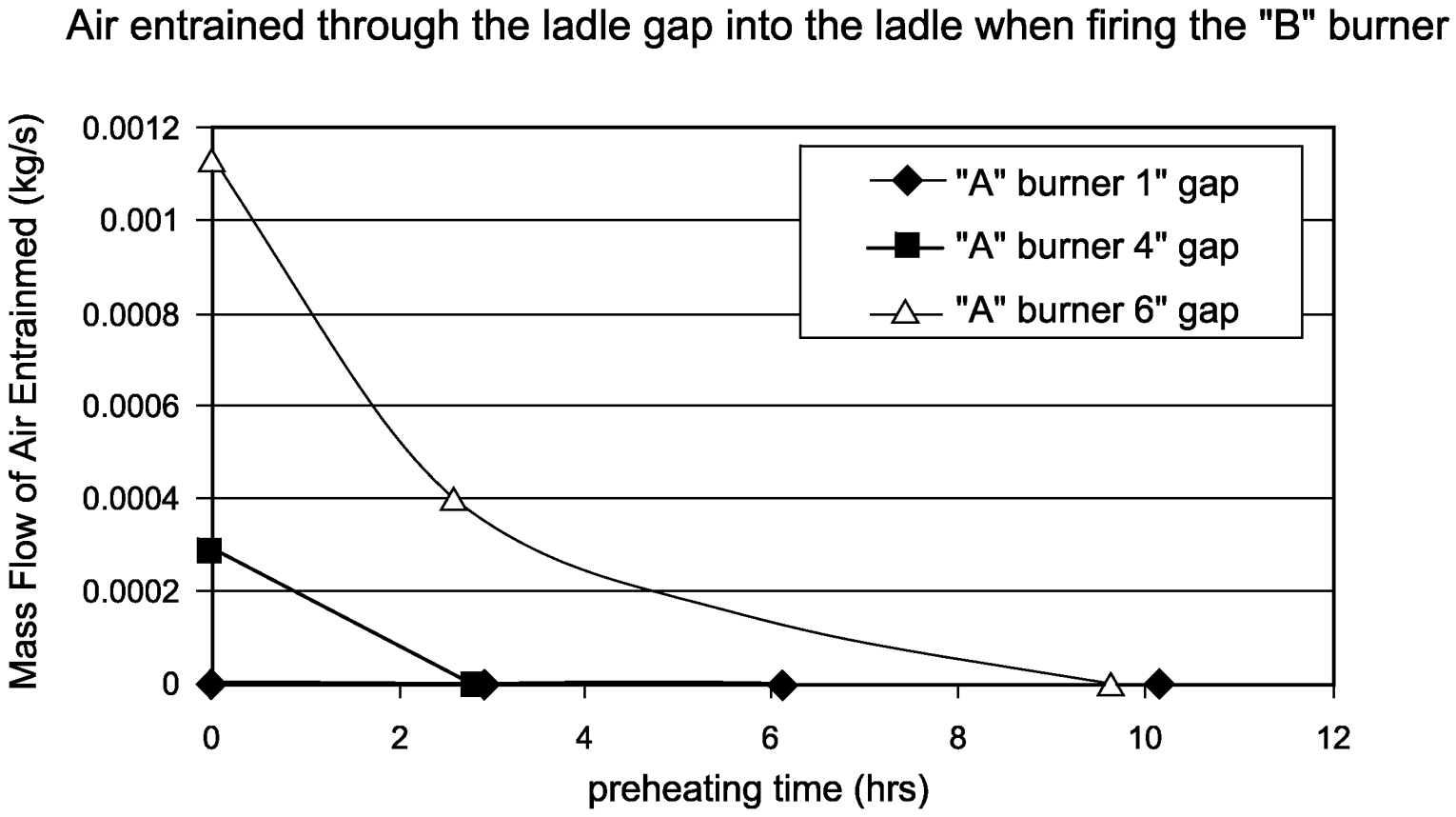
FIG. 6 is a plot of mass of air entrained vs. preheating time for a conventional oxy-fuel burner.

The CFD results show that ambient air is drawn in the ladle through the gap when firing the "A" burner. In general, the air entrainment is the most serious at the start of the heating process, when the ladle is coolest and the buoyance is the strongest. As expected, the entrainment also increases with the gap size. For the conventional oxygen burner, the air entrainment is negligible during the whole process when the gap size is 1 inch. The entrainment becomes substantial when the gap size increases to 2 inches, lasting for the first 3 hours (FIG. 5). The entrainment becomes even greater and continues during the whole process for the 6 inch gap.

The air entrainment when using the high momentum "B" burner according to the present disclosure is similar in trends, in terms of the time and gap, but the magnitude is reduced significantly. Comparing FIG. 5 with FIG. 6, it can be seen that the air entrainment is reduced by at least two orders of magnitude for all the gap sizes. This reduction in air entrainment greatly decreases the ladle heating time.

Figure 7:
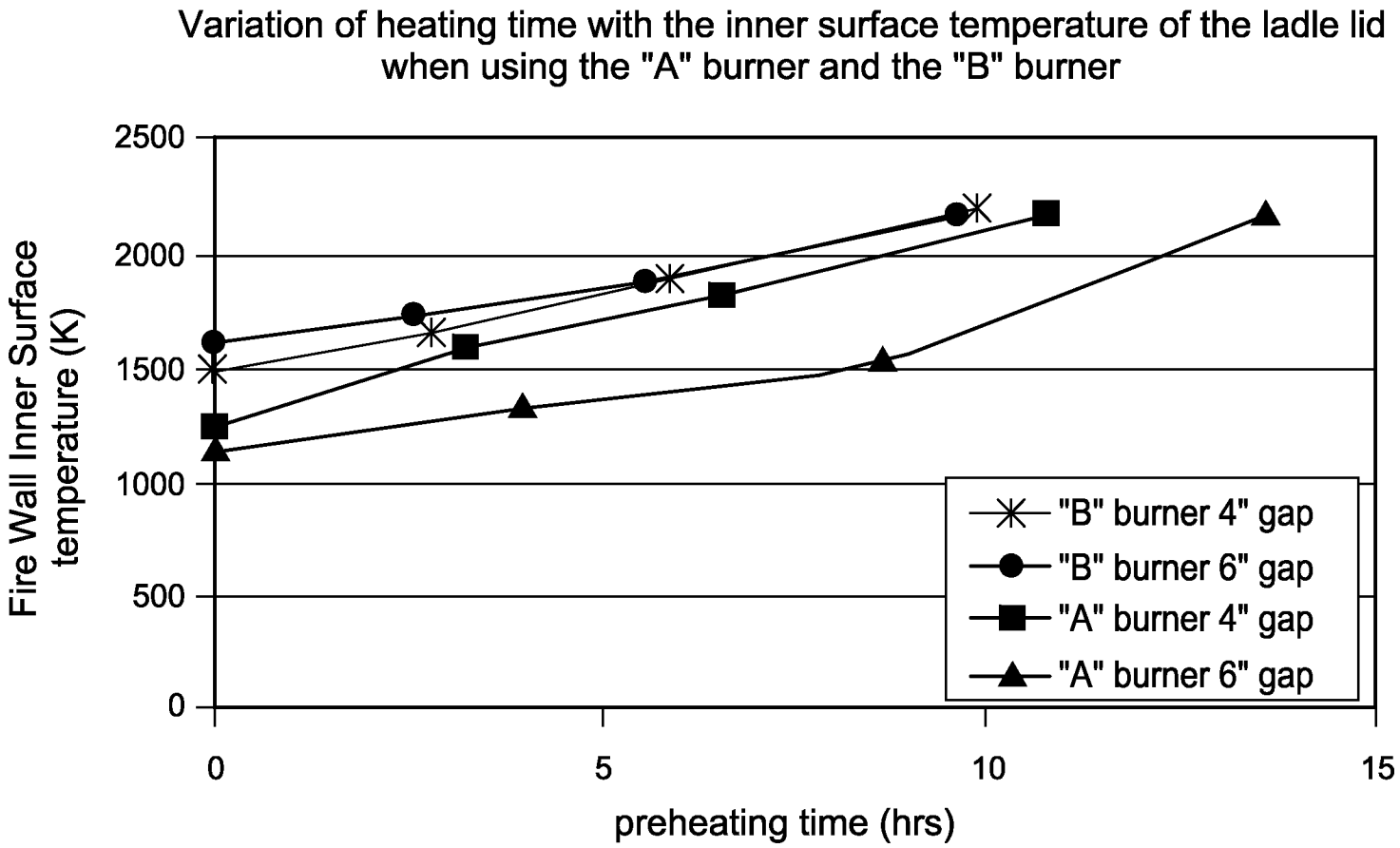
FIG. 7 is a plot of ladle inner surface temperature vs. preheating time for a conventional oxy-fuel burner and a burner according to an embodiment of the disclosure.

The heating time required to reach the desired temperature of the refractory lining is shown in FIG. 7, which presents the variation of the inner surface temperature of the lid of the ladle versus heating time. The firing rate of the "B" burner or the "A" burner in FIG. 7 is fixed at 6 MMBtu/hr for comparison. The average gap between the lid of the ladle and the ladle rim presented in FIG. 7 is 4 inches and 6 inches. Using the conventional oxygen-fuel burner, the time required to heat the ladle to 2000 K is 9 and 12.5 hours for a gap size of 4 inches and 6 inches, respectively. When using this invention, the required heating time is about 8 hours for both 4 inches and 6 inches gaps.

FIG. 8 shows the air entrainment with different combinations of the operational parameters "a" and "b". It is clear that the air entrainment can be reduced or eliminated by decreasing "a" or "b". In this example, the jet velocity is about 30 m/s for the conventional oxygen-fuel burner and 100 m/s for the high momentum burner. The burner face is about 3.3 inches in diameter for the conventional burner and 4.2 inches for the high momentum burner.

FIG. 9 shows the total time required to heat the ladle to 1400K with different combinations of the operational parameters a and b. Again, the jet velocity is about 30 m/s for the conventional oxygen-fuel burner and 100 m/s for the high momentum burner. The burner face is about 3.3 inches in diameter for the conventional burner and 4.2 inches for the high momentum burner.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. An apparatus for heating vessels having an enclosed space and controlling air ingress into the enclosed space, the apparatus comprising:

a lid structure having a burner assembly mounted therein, the vessel and lid structure mating such that a circumferential gap is formed between the vessel and the lid structure, the vessel having a diameter $D_{ladle}$, the gap having an area $A_{gap}$, the burner assembly comprising:

a burner face adjacent a combustion zone, the burner face having an area $A_{bf}$;

an elongated body terminating at the burner face, the elongated body having an oxidant conduit configured to discharge oxidant into the combustion zone at a jet velocity $V_{jet}$; and two or more nozzles disposed in the burner face at positions spaced apart from each other to discharge separate flows into the combustion zone, at least one nozzle being an oxidant nozzle positioned radially outward from the oxidant conduit and configured to discharge oxidant into the combustion zone and at least one nozzle being a fuel nozzle positioned radially outward from the oxidant nozzle and configured to discharge fuel into the combustion zone;

wherein the burner assembly is configured to combust fuel and oxidant from the burner assembly under conditions to provide a flame having a flame temperature $T_{flame}$ and a predetermined flame diameter and to impart a flame velocity sufficiently large to create an outward gas flow from the enclosed space through the gap and control air ingress;

wherein a burner configuration ratio of the gap area to the burner face area is determined by the equation: $a=A_{gap}/(200\ A_{bf})$;

wherein a burner velocity ratio determined by to the equation: $b=3V_{buoy}/V_{jet}$;

wherein $V_{buoy}=(2gD_{ladle}\Delta T/T_{flame})^{1/2}$, where $\Delta T$ is the temperature difference between the $T_{flame}$ and a wall of the vessel;

wherein the sum of the burner configuration ratio, a, and the burner velocity ratio, b, is less than 2.5; and wherein the oxidant is an oxygen-enriched gas.

2. The apparatus of claim 1, wherein the sum of the burner configuration ratio, a, and the burner velocity ratio, b, is less than 2.

3. The apparatus of claim 1, wherein the vessel is a ladle for pouring molten metal.

4. The apparatus of claim 1, wherein the vessel is a furnace for metal melting.

5. The apparatus of claim 1, further comprising a flame stabilizer disposed in the burner face and configured to combust fuel with oxidant, the oxidant being an oxygen-containing gas having a composition in the range of 20.9 vol % to greater than 99.5 vol % oxygen, and to discharge combustion products therefrom into the combustion zone.

6. The apparatus of claim 1, wherein air ingress is substantially prevented.

* * * * *